United States Patent [19]

Comer

[11] Patent Number: 5,039,533

[45] Date of Patent: Aug. 13, 1991

[54] BONE PLASTIC CAP FOR MEAT

[76] Inventor: Robert E. Comer, 1228 42nd Ave., Greeley, Colo. 80634

[21] Appl. No.: 443,664

[22] Filed: Nov. 29, 1989

[51] Int. Cl.[5] ..... B65D 85/00

[52] U.S. Cl. ..... 426/129; 426/124

[58] Field of Search ..... 426/129, 124, 392, 412, 426/413; 53/432, 434, 433; 229/2.5 R

[56] References Cited

U.S. PATENT DOCUMENTS

| | | | |
|---|---|---|---|
| 4,029,822 | 6/1977 | Comer | 426/124 |
| 4,136,205 | 1/1979 | Quattlebaum | 426/129 |
| 4,267,960 | 5/1981 | Lind et al. | 426/129 |
| 4,863,784 | 9/1989 | Lustig et al. | 426/129 |

FOREIGN PATENT DOCUMENTS

| | | | |
|---|---|---|---|
| 1397648 | 6/1975 | United Kingdom | 426/129 |

*Primary Examiner*—Donald E. Czaja
*Assistant Examiner*—Tony Weier
*Attorney, Agent, or Firm*—Norvell E. Von Behren

[57] ABSTRACT

A bone plastic cap for meat such as beef, pork, lamb, poultry and the like. The cap is formed with at least one or more separate sheets of material in the approximate shape of portions of the meat and is designed to cushion exposed bone portions from piercing the outer vacuum sealed bag surrounding the meat. The cap is formed in one embodiment in two separate juxtaposed shapes tacked together with holes or slits cut through both shapes. As the outer bag has air removed, during the vacuum sealing, it collapses on the bone plastic cap which in turn collapses on the meat. The separate preformed shapes collapse independently and slide upon each other with the inner shape forming the primary cushion and the outer shape forming a backup cushion. Bridging of concaved areas by the bone cap is eliminated reducing growth of bacteria in these areas. The bone plastic cap may also be formed in other embodiments such as in a single sheet or in multiple sheet configurations and may also be formed with expansion means such as pleats and/or corrugations to permit the cap to be positioned over larger oversized cuts of meats. The expansion means may be formed in the single sheet configuration as well as in the multiple sheet configurations of two sheets, three sheets and others.

24 Claims, 2 Drawing Sheets

BONE PLASTIC CAP FOR MEAT

BACKGROUND OF THE INVENTION

This invention relates generally to a cushion device for packaging meats and more particularly to a new and novel bone plastic cap that is positioned over exposed bone areas to cushion the area to prevent the exposed bone portions from piercing the outer vacuum sealed bag and also to eliminate bridging of areas where bacteria can grow faster than desired.

In the modern-day processing of freshly killed meat, problems occur during the packaging process where vacuum sealing of the meat in an outer bag is employed. Large cuts of meat are often processed for sale to a butcher rather than to the ultimate retail consumer. The local butcher then re-cuts the meat for display and resale to the purchasing public. Since these various types of meat cuts can be quite large and can vary in shape and in the cut of meat, the problem of preserving the cut in an outer vacuum bag manifests itself whenever an exposed bone portion tears the outer vacuum sealed bag. Portions of exposed bone can protrude from various places in the meat cut and may pierce the outer vacuumed bag. The destruction of the vacuum seal caused by the exposed bone pieces permits entry and rapid growth of bacteria in the package, thus reducing the shelf life of the meat. The visible evidence of bacteria growth is very apparent and can destroy the fresh appearance of the package of meat.

In order to overcome this major potential bone puncture problem, prior art solutions have attempted the use of separate cushions over the exposed bone area with a cloth material impregnated with wax or other soft pliable materials to accomplish a protective padding. Still other cushions have been tried using flat sheets of plastic material over the bone area. Both of the above have a distinct disadvantage of being labor intensive in application. The beeswax coated cushions did not permit the viewing of meat underneath the padding since it is not transparent. In addition, most types of padding did not solve the problem of eliminating the bridging pockets of entrapped air. Separate smaller cushions were labor intensive to apply and difficult to keep in place over the exposed bone portions during insertion into the outer vacuum sealed bag.

In addition to the above problem, certain types of meat are cut so that large concaved areas of indentation occur. As a result, the protective packaging material may bridge the area creating pockets of air in which bacteria can also grow quite rapidly. This bridging and consequent air entrapment further reduces the shelf life of the meat. An important function of this invention is to reduce the likelihood of bridging by designing and thermoforming a plastic part that roughly conforms to the cavities and contours of the cut of meat. Elimination of all entrapment of air is an important intent of the invention.

For a more detailed discussion of the problems using prior art cushion devices, reference should be made to the applicant's U.S. Pat. No. 4,029,822, issued on June 14, 1977. The above patent also details an attempted solution to the problems using a solid one-piece bone shield that was formed of a low density polyethylene plastic with a 12½% ethylene, vinyl acetate blend. This particular material was readily available in the period between 1970 and 1980. The previous bone shield was somewhat rigid as formed and contained preformed grooves between pleats that defined channels which were designed to carry meat juices. The plurality of pockets in the bone shield were also designed to trap the fluids that were squeezed from the meat and to produce the fluid-filled cushions to provide protection at the exposed bone areas.

This attempted solution, while appearing satisfactory in theory, did not practically operate as designed and was later replaced by the applicant's new and novel bone plastic cap of the present invention. Another problem soon surfaced in attempting to solve the problems before described. In order to obtain a better protection on the exposed bone portions, it was felt that a thicker cushion could be used. The gage was 0.015 mils. This thicker material of approximately 0.015 gage possessed a memory that had an inherent inclination to balloon away from contact with the meat surface if the outer bag lost its vacuum thus permitting occasion for further bacterial growth. However this led to the bridging problem becoming more severe. Whenever a thicker material was used to cushion exposed bone, the bridge became stronger and could not collapse tightly into all indentations on the meat as the outer bag was evacuated. As a result, the before described pockets of air resulted where bacteria could grow faster. In other words, the reduction of one problem (bone tears) caused an increase of the other problem (bridging with increased bacteria growth in air pockets). A more detailed discussion of this problem will be given when referring to FIG. 2 of the drawings.

SUMMARY OF THE INVENTION

In order to overcome the before described problems, there has been achieved by the applicant's new bone plastic cap a totally new approach to the problem. The applicant's novel solution, in the preferred embodiment, provides a cushion device which is preformed out of an ultra low density polyethylene (ULDPE) plastic into the approximate shape of at least a portion of the meat to be covered. The preformed cushion also has preformed concaved areas that correspond to the contours of the meat surface. The preformed bone plastic cap is formed of a collapsible plastic material which will both cushion the exposed portions of bone and will also collapse into the concaved areas of indentation on the meat during the vacuum sealing of the outer bag. The collapse of the bone plastic cap eliminates the pockets of air and also the bridging problems previously discussed. Novel means have been incorporated on the applicant's bone plastic cap to insure that no entrapped air is left and that evacuation of all air is complete thereby insuring a good vacuum sealed product.

In one embodiment of the invention, this novel solution to the multiple problem is obtained using a collapsible bone plastic cap which is formed in at least two separate juxtapositioned shapes with each shape having an outer flange, with adjacent flanges being fixed together at spaced intervals. By fixing the flanges together at spaced predetermined intervals, entrapped air may be more easily evacuated from between the two separate juxtapositioned shapes.

In addition, each preformed shape has means for releasing entrapped air in the form of holes or slits cut through both shapes at spaced distances. With the use of separate preformed shapes of the type of plastic material before described in combination with the holes or slits in the preformed shapes and the use of outer flanges which are fixed together at spaced intervals, the prior art problems are completely solved.

The inner preformed shape will first encapsulate the exposed sharp bone edges and/or points while the outer preformed shapes are free to slide or move independently as each shape collapses over the meat whenever the outer vacuum sealed bag is applied. This will be discussed more fully hereinafter, especially when referring to FIGS. 3–7 of the drawings which show the applicant's novel product.

By using at least two separate preformed juxtapositioned shapes of approximately 0.005 to 0.008 inches thick, the appropriate bone cushioning is obtained as well as the elimination of air pockets since both preformed thin and flexible shapes will totally collapse in the concaved areas of indentation during vacuum sealing of the outer bag and will not bridge across the crevice or larger cavities.

Accordingly, it is an object and advantage of the invention to provide a new and novel plastic bone cap which will provide the necessary toughness to cushion exposed bone and which will also provide the necessary flexibility to collapse onto all the areas of the meat thereby eliminating pockets of entrapped air where increased bacteria growth can occur.

Another object and advantage of the subject invention is to provide a new and improved plastic bone cap which has improved shrinkability so that when run through existing heat tunnels of approximately 195 degrees Fahrenheit for approximately 6 seconds and respond by further tightening itself against the surface of the meat.

Another object and advantage of the invention is the aesthetic quality of clarity that it adds to the package. The meat may now be clearly seen through the vacuumed package, which was not the case with the wax impregnated cloth or reinforced laminated bags commonly used.

Still another object and advantage of the subject invention is to provide a new and novel cushioning device that is formed out of separate sheets of material with holes or slits with the sheets having low slippage therebetween and with the separate preformed shapes being tacked together in a manner that will permit entrapped air to be easily evacuated from between the sheets while still permitting the preformed shapes to function as a unit.

It is believed that the first of these sheets to make contact with a bone point will encapsulate it and permit the second sheet to locate itself over the same bone point but without the inherent stress that exists with the sheet that first made contact with the bone. The absence of such stress makes the second sheet less vulnerable to puncture. A third sheet, if used, would react similarly to the second in positioning without stress as well as the protection of another gage thickness. The three-ply modification, as shown in FIG. 11, would be an option reserved only for the most extremely difficult bone frequency and sharpness.

Still another unique and novel feature is incorporated in the invention to allow expansion by means of corrugations and pleats positioned as later shown in the drawings to accommodate larger than average cuts of meat. The expansion means may be used with all of the variations of the invention as will be described.

In yet another object and advantage of the invention, the basic concept may be used in a single sheet configuration which functions like the before described multiple sheet versions to completely encapsulate exposed sharp bone edges and to minimize bacterial growth in the meat package.

These and other objects and advantages and modifications of the subject invention will be clearly seen when studying the accompanying drawings and when reading the following Description of the Preferred Embodiment which has been given by way of illustration only.

DESCRIPTION OF THE PREFERRED EMBODIMENT

Figure 1:
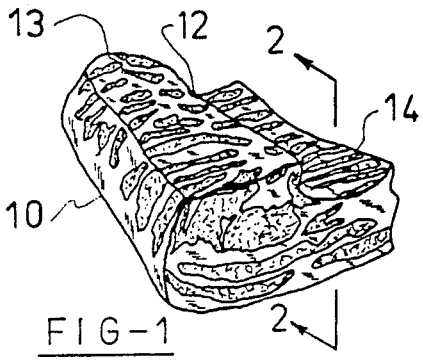
FIG-1 PRIOR ART
FIG. 1 is a perspective view of a typical large cut of meat of the before described type having exposed bone portions and having a concaved area of indentation.

Referring now to the drawings in general and in particular to FIG. 1 of the drawings there is shown in a perspective view, generally by the numeral 10, a typical large cut of meat of the type which may be shipped to a supermarket for cutting into smaller portions by the local butcher. The meat cut 10 may have a line 12 of exposed bone portions as well as a line 14 of similar bone portions. Exposed portions of bone may also be found in the top area 13. Other types of large meat cuts may also have exposed bone portions or ends in different locations which can pierce the outer vacuum sealed plastic bag in which the meat cut would be packaged for shipment to the wholesale distributor or supermarket.

Figure 2:
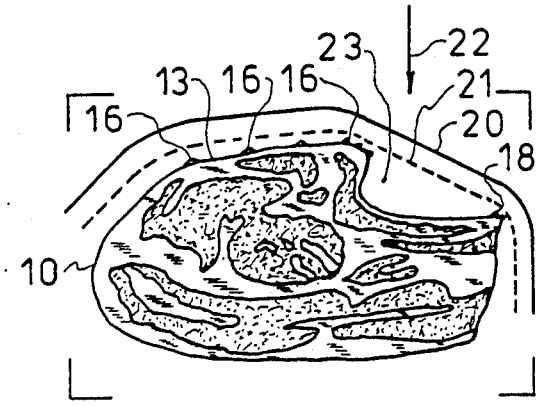
FIG-2 PRIOR ART
FIG. 2 is an end elevational view, taken along line 2—2 of FIG. 1 showing one prior art type of cushioning device in dotted lines applied over exposed portions of bone.

Referring now to FIG. 2, there is shown an end elevational view, taken along line 2—2 of FIG. 1, showing how one type of prior art cushioning has been used in the past and is positioned over the exposed bone lines 12 and 14. In FIG. 2, the exposed bone has been shown enlarged for purposes of clarity and the pieces of bone 16 would lie along the bone line 12 and in the top area 13 while pieces of bone 18 would also lie along the bone line 14. As previously discussed, a beeswax coated material 20, approximately 14 mil thick, would often be positioned as shown in FIG. 2 by the arrow 22 and would be placed over the pieces of bone 16 and 18 as shown by the dashed line 21. The wax impregnated cloth sheeting does pull in tightly and protects from the piercing by the sharp bones to a degree. However it has application and visual disadvantages as compared to the applicant's novel improvement.

The wax impregnated cloth is labor intensive in application when compared to the fast and efficient capping on of the applicant's product. The visual disadvantage is that the wax sheet does not possess clarity to permit viewing of the meat in the area 23 beneath the cloth sheeting.

Figure 3:
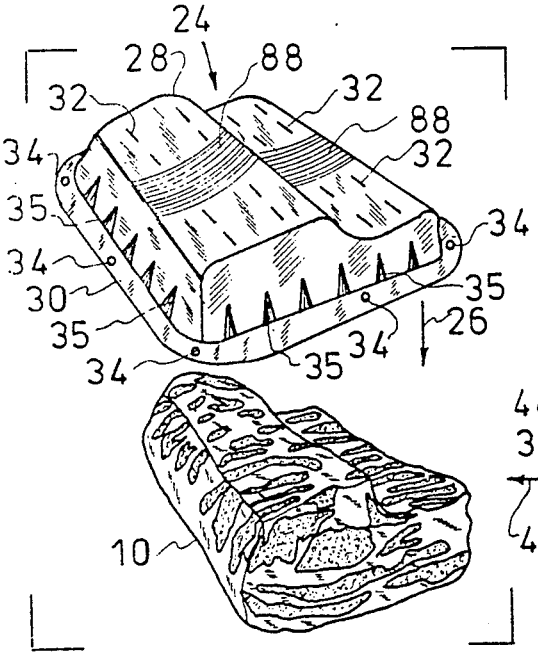
FIG. 3 is a perspective view of the cut of meat shown in FIG. 1 showing the applicant's novel bone plastic cap positioned on top of the cut of meat prior to being positioned over the areas of exposed bone with the expansion means in the form of corrugations and pleats also being shown.

Referring not to FIG. 3 there is shown in a perspective view, the typical large cut of meat 10 with the applicant's new and novel bone plastic cap in the two sheet embodiment, shown generally by the numeral 24. The cap is shown on top of the meat 10 prior to its being placed over the meat in the direction of the arrow 26. The novel bone plastic cap 24 is formed in the approximate shape of the meat to be covered. The formation of the shape is by known plastic forming techniques which are not a part of this disclosure. The cap 24 is formed in the embodiment shown in FIG. 3 with at least two separate juxtapositioned preformed shapes having outer flanges which are fixed together at predetermined positions and for reasons which will be discussed more fully hereinafter.

In FIG. 3 the outer preformed shape can be seen and comprises a first outside central preformed panel 28 formed out of a resilient plastic material in the approximate shape of the portion of meat to be cushioned. A first outer flange 30 is formed on the central panel 28 around the periphery of the panel. The flange strengthens all of the sides of the preformed central panel 28 with sufficient rigidity to facilitate the bone plastic cap 24 standing up and being capable of easy nesting in the plastic forming plant, shipping and easy de-nesting by the line workers in the meat packaging plants. Expansion means in the form of vertical pleats 35 may be formed around the sides where shown and expansion means in the form of corrugations 88 may also be formed as shown and in other directions. The expansion means will be discussed in more detail hereinafter when referring to FIG. 8 of the drawing.

The applicant's plastic bone cap 24 has a series of holes or slits 32 through the central panel 28 which serve as the second means for releasing entrapped air from around the meat 10 and from between the juxtaposed panels as will be discussed more fully hereinafter. These holes or slits 32 would be formed with a piercing awl or some other suitable type piercing tool.

Figure 4:
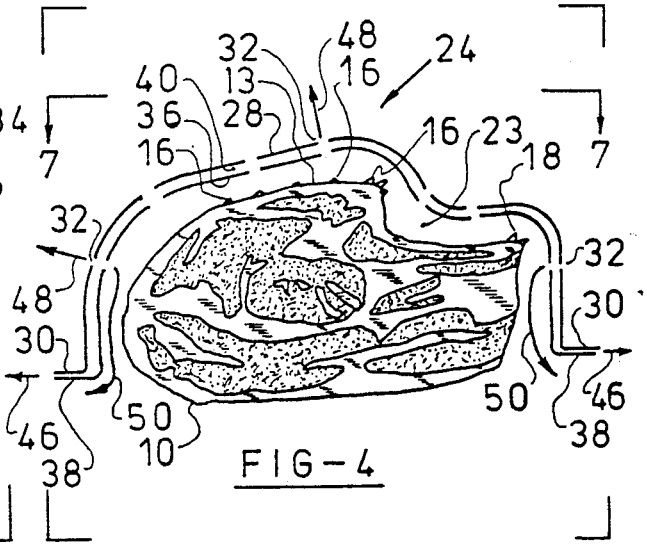
FIG. 4 is an end elevational view, similar to the view of FIG. 2, showing the applicant's two sheet version of the bone plastic cap in place and showing the two separate preformed shapes of plastic in juxtaposition to each other and to the cut of meat.

Referring now also to FIG. 4, there is shown an end elevational view, similar to the view of FIG. 2 but showing in enlarged detail the applicant's novel bone plastic cap 24 positioned over the meat portions to be cushioned. It can be seen in FIG. 4 how the two-piece variation of the bone plastic cap 24 may be formed in the preferred embodiment in at least two preformed shapes. The inner shape is formed with a second inside central panel 36 similar in size and shape to the first outside central panel 28. A second outer flange is also formed around the periphery of the sides and the inner shape and is fixed to the first outer flange by heat tack welding at 34 as shown in FIG. 3 or by some other suitable means.

The tacking or fastening together of the inner flange 38 to the outer flange 30 at predetermined spaces forms the first means to fixedly attach the flanges together. By fixing the flanges at predetermined intervals, entrapped air may also be evacuated from between the first and second panels 28 and 36 in the untacked spaces as will be more fully detailed later when referring to FIGS. 5–7 of the drawings.

FIG. 4 has been drawn in an enlarged detail to show more clearly the two-piece construction of the bone plastic cap 24 with the panels 28 and 36. They are nested together with their outer flanges 30 and 38 tacked together at 34. When positioning the complete plastic bone cap 24 over the meat 10 the purpose of the design is to fit and correspond as nearly as possible to the contoured surface of the meat and to cover all exposed bone areas. Since all of the cuts of meat are not precisely the same size and form and the exposed bone pieces 16 and 18 are not always exposed where shown on different cuts of meat, designs must be customized for each standard configuration.

In FIG. 4 there can also be seen how both the outer central panel 28 and the inner central panel 36 have the holes or slits 32 formed therein. As the evacuation of air starts during the vacuum sealing of the outer bag, entrapped air is removed as shown by the arrows 46, 48 and 50 in the directions shown. Entrapped air between the panels 28 and 30 can be removed through the holes or slits 32 outwardly in the direction shown by the arrow 48. The entrapped air can also be removed inwardly towards the meat 10 as shown by the arrow 50. In a similar manner, this entrapped air can also be removed by passing between the outer flange or skirt 30 and the inner flange or skirt 38 through the untacked spaces as shown by the arrow 46.

The materials used in the preferred embodiment of the bone plastic cap should be ultra low density polyethylene (ULDPE) transparent food grade plastic. Each central plane 28 and 36 as well as the flanges 30 and 38 would be formed from sheets approximately 0.005 to 0.010 inches thick. This type of material and thickness permits the inside plastic panel 36 to make contact with and encapsulate the exposed bone and to collapse without bridging across cavities and crevices owing to its thin gage and exceptional inherent flexibility. The outer panel 28 would almost simultaneously follow the inside panel 36 but would not be held in stress but rather more readily conform with minimal tension over the sharp bones and inner sheet.

While emphasis has been made in this discussion of the elimination of bridging over the area 23, it should be noted that the area 23 shown may be only one of many such areas in the large meat cut depending upon the type of cut. These areas of air entrapment are all generally concaved in some shape or may also be seen as indentations in the overall outline of the meat. By the use of the applicant's novel bone plastic cap 24 formed as described with the materials typified in the two-piece embodiment and other embodiments to be described hereinafter, the novel cap is designed both to cushion and to collapse into these troublesome areas during vacuum sealing of the outer plastic bag.

Figure 5:
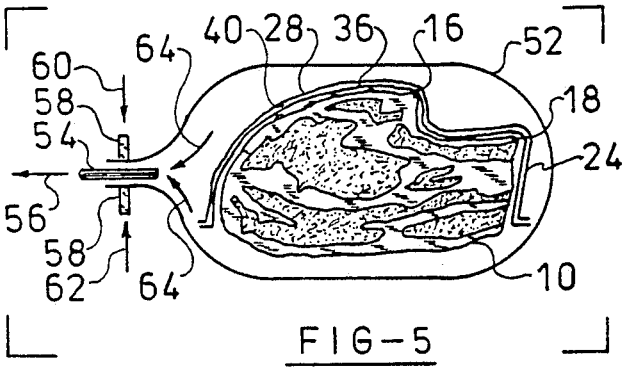
FIG. 5 is a reduced end elevational view, similar to the view of FIG. 4, showing the outer vacuum sealed plastic bag positioned around the previously covered cut of meat of FIG. 4 and showing the outer plastic bag at the start of the evacuation process.
Figure 6:
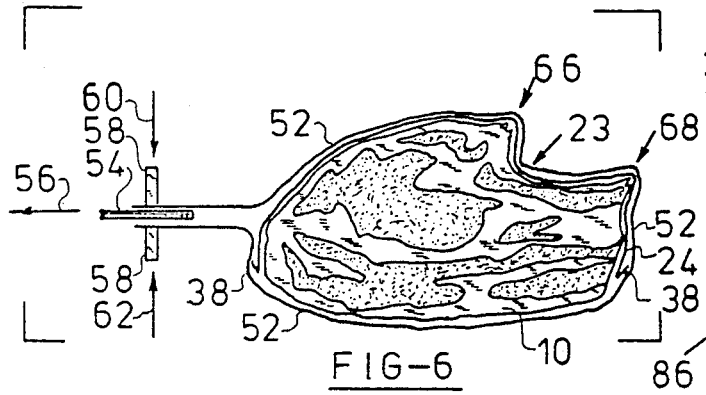
FIG. 6 is a view similar to the view of FIG. 5 showing how the outer plastic bag collapses on the applicant's bone plastic cap which in turn collapses on the cut of meat as the evacuation process is completed to eliminate the before described bridging.

FIGS. 5 and 6 show in detail how this occurs. FIG. 5 is a reduced end elevational view, similar to the view of FIG. 4. It is not drawn in enlarged detail but is drawn closer to an actual representation with the preformed bone plastic cap 24 shown as it would be when placed on top of the meat 10. As before described, after the meat is cushioned with the applicant's novel bone plastic cushion 24, the large meat cut is then positioned by known techniques on the inside of an outer plastic bag 52 which has its open end placed over an air evacuation device 54.

Air is then evacuated in the direction shown by the arrow 56 from the open end of the bag 52 until a vacuum in the range of approximately 20 to 25 inches of mercury is obtained. A heated pressure sealing device 58 then seals the bag end with pressure being applied to the bag end in the direction shown by the arrows 60 and 62. As the evacuation device 54 withdraws air inside the bag 52, as shown by the arrows 64, the outer bag begins to collapse.

Since the inner central panel 36 is formed separate from the outer central panel 28 with a space 40 therebetween, the panels are free to slide over each other as the outer bag collapses and forces the panels 36 and 28 to take the shape of the meat 10. Since this occurs rather rapidly and can not be easily documented, it is believed that the sliding of the two central panels permits the inner panel 36 to first form itself over the exposed bone pieces 16 and 18 as the primary cushion against piercing of the outer bag 52. The outer panel then is believed to be a secondary cushion which is formed somewhat later in time, although probably only a split second later.

It is believed that this occurs as described since the outer bag 52 will first collapse onto the outer central panel 28 which in turn then collapses onto the inner central panel 36. With the particular plastic used in the thicknesses given, the total collapse in the area 23 eliminates the bridging before described between the areas 66 and 68 as shown in FIG. 6. The total collapse in the area 23 as well as in all the concaved areas of indentation on the meat is shown in FIG. 6 which is a view similar to the view of FIG. 5 but represents the outer bag 52 and the inner bone plastic cap 24 totally collapsed after the proper vacuum is obtained. In FIG. 6, the applicant's novel bone plastic cap 24 has been shown in single line for purposes of clarity and only the second outer flanges 38 have been shown to illustrate that they, as well as the first outer flange 30, also collapse or are bent as shown under the vacuum in the bag 52. The applicant's novel transparent bone plastic cap forms itself so tightly over the meat 10 that it is virtually invisible through the outer plastic bag 52. This means that the entire cut of meat can be observed and no areas are hidden by cushioning material.

Figure 7:
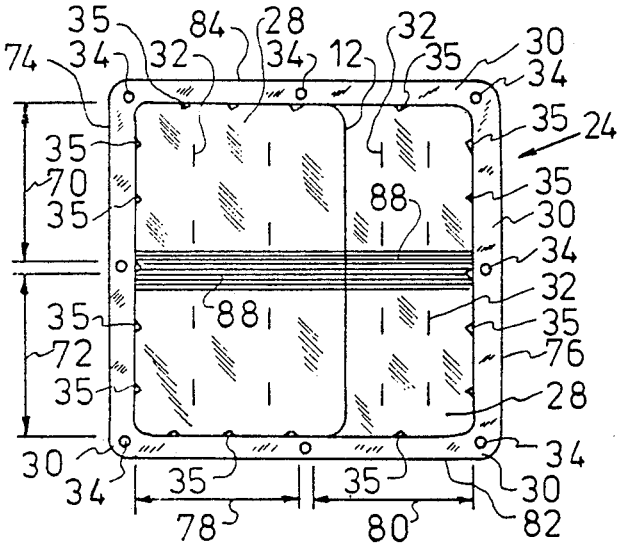
FIG. 7 is a top plan view, taken along line 7—7 of FIG. 4, showing in detail the holes or slits cut through the inner and outer preformed shapes of the applicant's device and also showing how both shapes are fixed or tacked together at predetermined spaces to allow entrapped air to be evacuated from between the separate forms through the untacked spaces. The expansion means in the form of corrugations and pleats can also be clearly seen.

Referring now to FIG. 7 there is shown a top plan view, taken along line 7—7 of FIG. 4, detailing the position of the holes or slits 32 cut through the outer panel 28 as well as the inner panel 36. FIG. 7 also details more clearly the spacing 70 and 72 of the tacking 34 along one pair of opposite sides 74 and 76 and the spacing 78 and 80 along the other pairs of opposite sides 82 and 84. Since areas 70, 72, 78 and 80 around the entire periphery of the flanges or skirts 30 and 38 are untacked or unsealed, entrapped air may be easily evacuated by the vacuum device 54 as before described. The spacing and total number of tacks would be determined according to the size and shape of the bone plastic cap. While eight tacks have been shown in the FIG. 7 shape, more or less may be used within the spirit and scope of the invention.

Figure 8:
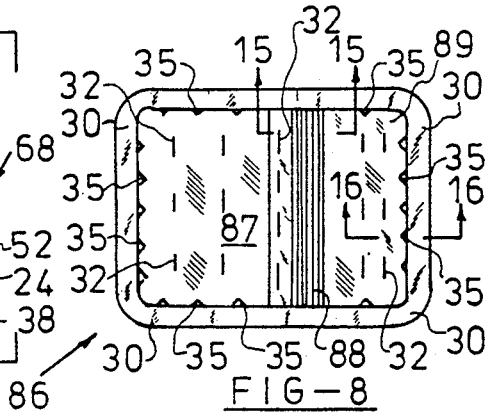
FIG. 8 is a reduced top plan view, similar to the view of FIG. 7, showing another embodiment of the applicant's novel bone plastic shield formed in a single sheet and also formed with expansion means using corrugations and pleats.

Referring now to FIG. 8 there is shown a reduced top plan view, similar to the view of FIG. 7, showing another embodiment of the applicant's novel plastic bone cap, which is formed in a single sheet and is also formed with expansion means using corrugations 88 and pleats 35. The modified form, shown generally by the numeral 86 has been shown with the expansion pleats 35 and corrugations 88 which provide for expansion of the modified bone plastic cap 86 outwardly to accommodate oversized meat cuts without tearing the cap. Further details on these features will be discussed hereinafter when referring to FIGS. 15 and 16 of the drawings.

Figure 9:
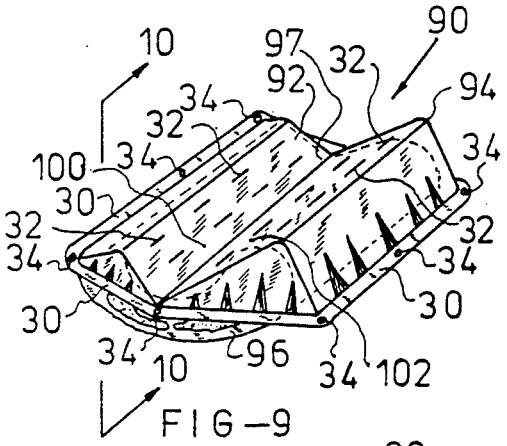
FIG. 9 is a perspective view of a different cut of meat and showing still another form of the bone plastic cap applied over portions of the meat.
Figure 10:
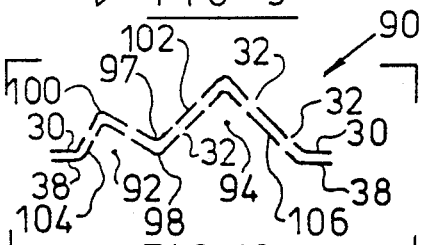
FIG. 10 is an end elevational view, taken along line 10—10 of FIG. 9, showing in more detail the construction of the modified form of the bone plastic cap formed in two separate shapes, which are hinged together.

Referring now to FIG. 9 there is shown a perspective view of a different type of meat cut as shown by the numeral 96 which may be a short loin or similar cut of meat. When using the applicant's novel invention a modified bone plastic cap 90 would be formed with two differently formed shapes 92 and 94 to cover different areas of the loin. A hinge line 97 would be formed between the first outside central panel 100 and the first outside central panel 102. The modification 90 of the applicant's basic invention may also have an inner two shaped panel construction as can be seen in FIG. 10 with a second inside central panel 104 lying in juxtaposition to the outer central panel 100. Similarly the second inner panel 106 would lie in juxtaposition to the outer central panel 102 with both panels 104 and 106 also being separated by a hinge line 98. The modification 90 may also be formed in a single sheet construction and in a triple sheet construction within the spirit and scope of the invention.

Figure 11:
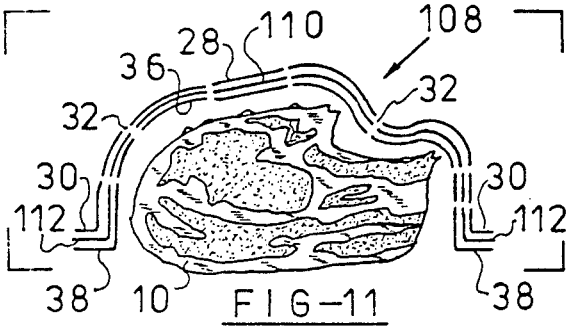
FIG. 11 is an end elevational view, similar to the view of FIG. 4, showing still another modification of the applicant's novel bone plastic cap formed with at least three separate juxtaposed similar shapes which are tacked together at predetermined intervals along the peripheral flanges.

The modified bone plastic cap 90 would also be formed with the first attaching means 34 and the air releasing means 32 formed through both panels and the inner and outer flanges 38 and 30 as before described. When formed in a single sheet configuration, the first attaching means would be eliminated and the air releasing means 32 would be used. While the preferred embodiment 24 and the modified form 90 of the plastic bone cap have been shown and described as having two separate thicknesses of plastic, it is within the spirit and scope of the invention that one to three or more thicknesses of plastic may also be desirable. FIG. 11 shows another modified device 108 with a first outer central panel 28 and a second inner central panel 36 having a middle central panel 110 positioned therebetween. The middle central panel 110 also contains an outer flange 112 around the periphery thereof which would be tacked to the flanges 30 and 38 as before described in predetermined places. In addition, the middle central panel 110 as well as the panels 28 and 36 have the holes or slits 32 formed therein to release entrapped air.

Figure 12:
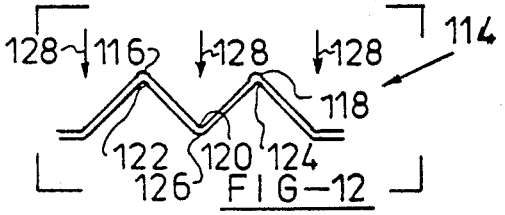
FIG. 12 is an end elevational view, similar to the view of FIG. 10, showing yet another modification of the applicant's novel bone plastic cap.
Figure 13:
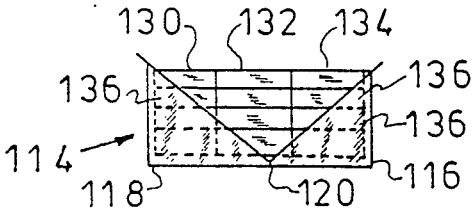
FIG. 13 is an end elevational view of the modifications of FIG. 12 showing how it is inverted and used as a tray to hold three rows of four each packages of another cut of meat.

Turning now to FIGS. 12 and 13 there is seen another modified form of the invention shown generally by the numeral 114 formed with two separate outside central panels 116 and 118 separated by an integral hinge line 120. Positioned inside thereof are a second pair of separate inside central panels 122 and 124 separated by an integral hinge line 126. The modified plastic bone cap 114 would be formed as shown in FIG. 12 in the direction shown by the arrows 128 and would be used to enclose three separate rows 130, 132, and 134 of four short ribs 136 more or less after being inverted and set up as a tray. This can be seen in FIG. 13 with the approximate twelve short ribs 136 contained in the package. If desired, the entire package of approximately twelve short ribs 136 may also be positioned in an outer vacuum sealed plastic bag 52 in which case the holes or slits 32 shown in FIG. 7 would be used with the spaced tacks 34 as before described to evacuate entrapped air.

Figure 14:
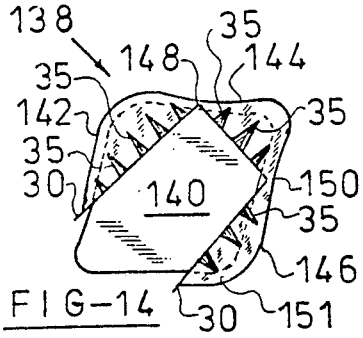
FIG. 14 is an end elevational view, similar to the view of FIG. 9, showing still yet another modification of the applicant's novel bone plastic cap formed in three separate hinged shapes for positioning over a much larger size of meat of a different cut.

Referring now to FIG. 14 of the drawings, there is shown an end elevational view, similar to the view of FIG. 9, showing still yet another modification shown generally by the numeral 138. Here a different cut of meat, such as a split chuck arm 140, requires the cushioning of three primary bone areas. The modified hinged design contains three differently formed shapes 142, 144 and 146 which are separated by two hinge lines 148 and 150. The flattest of the three molded shapes 146 is hinged down and tucks under the round bone side at 151.

The applicant's basic design features shown in the preferred embodiment 24 would also be employed in the modified form 138 and will not be reviewed at this time for purposes of brevity. However, it should now be clear that the basic novel invention may be used on all types of meats such as beef, lamb, pork, poultry and other as well as on other shapes all within the spirit and scope of the invention.

Figure 15:
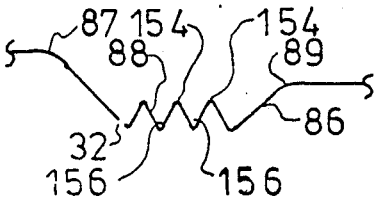
FIG. 15 is a cross-sectional elevational view, taken along lines 15—15 of FIG. 8, showing further details of the corrugation expansion means that may be used on a single sheet embodiment of the invention as well as on the multiple sheet forms.
Figure 16:
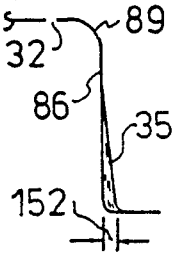
FIG. 16 is a cross-sectional elevational view, taken along lines 16—16 of FIG. 8 showing further detail of the pleat expansion means that may be used on a single sheet embodiment of the invention as well as on the multiple sheet forms.

Referring now to FIGS. 15 and 16 there will be described in more detail the expansion means in the form of the pleats 35 and the corrugations 88. FIG. 15 is a cross-sectional elevational view, taken along lines 15—15 of FIG. 8, showing how elongated corrugations 88 may be used on the single sheet version 86. These corrugations 88 and/or pleats 35 may also be desired on the multiple sheet versions and it can be seen how the corrugations 88 may be used in a different direction by referring to FIG. 7.

In order to accommodate larger cuts of meat that may occur at various times of the year, the use of elongated corrugations 88 may be incorporated into all of the plastic bone cap versions if desired. It is known that certain cuts of meat may vary as much as 15% over the standard size, as for example in the lamb industry where the lambs are traditionally fed more in the fall to make them larger. When such oversize conditions occur, the use of the corrugated expansion means 88 may be desirable.

When this occurs, parallel corrugations of peaks 154 and valleys 156 may be used to span the upper surface of some cuts of meat. The corrugations 88 would then allow an accordion action stretch to accommodate the larger cuts.

When a smaller expansion is desired, then the expansion pleats 35 may be used by themselves or in combination with the corrugations 88. FIG. 16 is a cross-sectional elevational view, taken along lines 16—16 of FIG. 8 and shows the pleat expansion means 35 used on the single sheet version of the applicant's novel bone cap. The pleats 35 are formed more or less vertical and are incrementally placed around the perimeter of the bone cap to also permit expansion of the bone cap outwardly to accommodate slightly oversized meat cuts. The pleats 35 may be formed as shown with a lower recess of approximately 0.1 inch dimension as shown by the numeral 152 in FIG. 16. This would allow a stretch of the bone cap of approximately ½" around the periphery of a typical bone cap of the type shown.

The expansion means using pleats 38 and/or corrugations 88 may be used on the single sheet versions of the applicant's invention as well as on the multiple sheet versions. In addition, where deeper undercuts of meat are to be packaged, additional slits 32 may be required in special areas to allow the plastic material to break away in bridge areas where the undercut is deep.

From the foregoing it can be seen that there has been provided a unique bone plastic cap that may be formed in one sheet or in multiple sheets, with the various versions accomplishing all of the objects and advantages of the invention as well as many others. While the embodiments shown and described have been given by way of illustration only, the applicant is not to be limited in his patent to these embodiments and other modified forms as shown of the basic novel concept which are considered to be within the spirit and scope of the invention.

Having described my invention, I claim:

1. A bone plastic cap for use over meat which is positioned inside of a separate outer plastic bag, the bone plastic cap being used for positioning over predetermined portions of pieces of meat having exposed bones, the cap being used at a meat processing plant to cushion the exposed bone portion from piercing the separate outer plastic bag which is later placed around the bone plastic cap on the meat and is vacuum sealed, comprising:

(a) a first outside central panel formed of a tough and resilient plastic and formed in the approximate shape of the portion of the meat to be cushioned;
a first outer flange, formed around the periphery of the first outside central panel;

(b) a second separate inside central panel formed of a resilient plastic and also formed in the approximate shape of the first outside central panel and lying in juxtaposition with the first outside central panel;
a second outer flange, formed around the periphery of the second inside central panel;

(c) first means, associated with the first and second flange, to fixedly attach the flanges together at predetermined spaced apart intervals along the flange; the fixation of the flanges at the predetermined spaced apart intervals permitting entrapped air to be evacuated between the spaced apart intervals and from between the first and second panels as the separate outer plastic bag is placed around the bone plastic cap and is vacuum sealed;

(d) second means, associated with the first and second central panels, for releasing entrapped air from around the meat and from between the panels as the separate outer plastic bag is placed around the bone plastic cap and is vacuum sealed, and (e) the first and second means along with the separate first and second central panels permitting the central panels of the bone plastic cap to collapse tightly around the meat and to cushion the exposed bone portions with the first and second means permitting air to be evacuated by the vacuum sealing and not to be entrapped within the separate bag, thereby minimizing bacteria growth inside the bag.

2. The bone plastic cap as defined in claim 1 wherein the second means for releasing entrapped air comprises a plurality of holes positioned throughout the first and second central panels.

3. The bone plastic cap as defined in claim 1 wherein the first outside central panel and the second inside central panel are formed of an ultra low density polyethylene plastic sheet.

4. The bone plastic cap as defined in claim 3 wherein each plastic sheet is approximately 0.005 to 0.010 inches thick.

5. The bone plastic cap as defined in claim 1 wherein the first and second central panels have formed in the vicinity of the outer flanges a plurality of expansion means in the form of vertical pleats permitting the bone plastic cap to be expanded as needed when positioned around oversized meat having a size somewhat larger than the size of the cap as formed.

6. The bone plastic cap as defined in claim 1 wherein at least one of the central panels has formed therein a plurality of expansion means in the form of horizontal corrugations permitting the bone plastic cap to be expanded as needed when positioned around much larger oversized meat than the size of the cap as formed.

7. The bone plastic cap as defined in claim 1 further comprising at least a third central panel formed and positioned between the first and second panel, the third panel constructed similarly to the first and second panel with an outer flange fixedly attached to the first and second outer flange and also having means for releasing entrapped air.

8. The bone plastic cap as defined in claim 1 further comprising the cap being formed in at least two differently formed shapes for positioning over different areas of the same piece of meat, and two differently formed shapes being attached together along a hinge line.

9. The bone plastic cap as defined in claim 8 further comprising the cap being formed in at least three differently formed shapes attached together along hinge lines.

10. In a package of meat of the type having exposed portions of bone, with the meat contained in a separate outer vacuum sealed bag and with a separate cushion device positioned over the exposed portions of bone to prevent the bone from piercing the separate sealed bag thus destroying the vacuum seal, the improvement comprising:

(a) the separate cushion device comprising a preformed bone plastic cap being formed in the shape of at least a portion of the meat;

(b) the separate bone plastic cap being formed in at least two separate juxtapositioned shapes, each separate shape having an outer flange formed thereon with the outer flanges being fixed together at predetermined positions around the periphery of the flange;

(c) the two separate juxtapositioned shapes having formed therein means for releasing entrapped air around the meat and from between the two separate shapes as the outer bag is vacuum sealed; and (d) the two separate juxtapositioned shapes and the releasing means in combination with the flanges fixed together at predetermined positions around the periphery of the flanges permitting the cushion device to collapse tightly around the meat and to cushion the exposed portions of bone as the separate bag is vacuum sealed, the two separate juxtapositioned shapes permitting the shapes to slide across each other during the collapse as one shape and then the other shape forms itself around the exposed portions of bone thereby preventing air from entrapping itself in the area of the exposed bone and any concaved area of indention and minimizing growth of bacteria on the meat which can cause spoilage of the meat.

11. The improvement as defined in claim 10 wherein the cushion device is formed with at least three similarly formed separate juxtapositioned shapes.

12. The improvement as defined in claim 10 wherein the bone plastic cap is formed in at least two differently formed shapes for positioning over different areas of the same piece of meat, the two differently formed shapes being attached together along a hinge line.

13. The improvement as defined in claim 10 further comprising the bone plastic cap being formed in at least three differently formed shapes attached together along hinge lines.

14. The improvement as defined in claim 10 wherein each of the two separate juxtapositioned shapes are formed of an ultra low density polyethylene plastic.

15. The improvements as defined in claim 14 wherein the plastic is approximately 0.005 to 0.010 inches thick.

16. In a package of meat of the type having exposed portions of bone, and concaved areas of indentation where package bridging may occur with the meat contained in a separate outer vacuum sealed transparent bag and having a separate cushion device with vertical sides, and horizontal surfaces positioned over at least the exposed portions of bone, the separate cushion device functioning to prevent the exposed portions of bone from piercing the separate sealed bag thus destroying the vacuum seal, the separate cushioning device also functioning to collapse into the concaved areas when the separate outer bag is vacuum sealed to thereby purge entrapped air from the areas of indentation, the improvement comprising:

(a) the separate cushion device comprising a preformed bone plastic cap which has the approximate shape of at least the exposed portions of bone and the approximate shape of the concaved areas of indentation;

(b) the separate preformed bone plastic cap being formed of a collapsible tough and resilient plastic material which will cushion the exposed portions of bone and will collapse into the concaved areas of indentation on the meat during the vacuum sealing of the separate bag, the collapse of the separate bone cap into the concaved areas of indentation minimizing the bacterial growth in the concaved areas as entrapped air is purged out of the area and out of the separate bag; and (c) the separate preformed bone plastic cap being formed with at least one sheet of collapsible plastic material.

17. The improvement as defined in claim 16 wherein the tough and resilient plastic is an ultra low density polyethylene plastic.

18. The improvement as defined in claim 17 wherein the plastic is transparent so that the meat is exposed beneath the cushion device and can be observed by a purchaser of the package of meat.

19. The improvement as defined in claim 16 wherein the cushion device is formed with at least two separate sheets of collapsible plastic material fixedly attached together at predetermined intervals.

20. The improvement as defined in claim 16 wherein the cushion device is formed with at least three separate sheets of collapsible plastic material fixedly attached together at predetermined intervals.

21. The improvement as defined in claim 16 wherein the cushion device is formed with a plurality of expansion means permitting the cushion device to be expanded as needed when the device is positioned around oversized meat.

22. The improvement as defined in claim 21 wherein the expansion means comprises at least a plurality of vertically positioned pleats formed in the vertical sides of the cushion device.

23. The improvement as defined in claim 21 wherein the expansion means comprises at least a plurality of horizontally positioned corrugations formed in at least one of the horizontal surfaces of the cushion device.

24. The improvement as defined in claim 21 wherein the expansion means comprises both a plurality of vertically positioned pleats formed in the vertical sides of the cushion device and a plurality of horizontally positioned corrugations formed in at least one of the horizontal surfaces of the cushion device.

* * * * *